US010143247B2

(12) United States Patent
Smith

(10) Patent No.: US 10,143,247 B2
(45) Date of Patent: Dec. 4, 2018

(54) AMBIDEXTROUS GLOVE WITH SENSITIVITY-ENHANCING DIGIT TIP INSERTS

(71) Applicant: Vincent T Smith, Chattanooga, TN (US)

(72) Inventor: Vincent T Smith, Chattanooga, TN (US)

( * ) Notice: Subject to any disclaimer, the term of this patent is extended or adjusted under 35 U.S.C. 154(b) by 100 days.

(21) Appl. No.: 15/147,624

(22) Filed: May 5, 2016

(65) Prior Publication Data

US 2017/0295867 A1 Oct. 19, 2017

Related U.S. Application Data

(63) Continuation-in-part of application No. 15/098,715, filed on Apr. 14, 2016.

(51) Int. Cl.

| | |
|---|---|
| ***A41D 13/08*** | (2006.01) |
| ***A41D 19/00*** | (2006.01) |
| *A41D 19/015* | (2006.01) |

(52) U.S. Cl.

CPC ..... *A41D 19/0082* (2013.01); *A41D 13/087* (2013.01); *A41D 19/0003* (2013.01); *A41D 19/0024* (2013.01); *A41D 19/0058* (2013.01); *A41D 19/01547* (2013.01)

(58) Field of Classification Search

CPC ..... A41B 19/04; A41D 13/08; A41D 13/087

See application file for complete search history.

(56) References Cited

U.S. PATENT DOCUMENTS

| | | | | |
|---|---|---|---|---|
| 2,736,034 | A * | 2/1956 | Fredenhagen et al. | A41D 19/01547 2/159 |
| 4,416,026 | A * | 11/1983 | Smith | A41D 19/0013 2/161.6 |
| 4,507,807 | A * | 4/1985 | Karkanen | A41D 19/0055 2/161.8 |
| 4,924,530 | A | 5/1990 | Tagaya | |
| 4,942,626 | A | 7/1990 | Stern et al. | |
| 5,442,816 | A | 8/1995 | Seketa | |
| 5,548,844 | A | 8/1996 | Ceresia | |
| 5,687,424 | A | 11/1997 | Masley | |
| 5,799,333 | A * | 9/1998 | McGarry | D04B 1/28 2/161.6 |
| 5,983,395 | A | 11/1999 | Lei | |

(Continued)

FOREIGN PATENT DOCUMENTS

WO 2015054438 A1 4/2015

OTHER PUBLICATIONS

International Search Report and Written Opinion for PCT/US2014/059784 dated Jan. 16, 2015.

*Primary Examiner* — Tejash Patel
(74) *Attorney, Agent, or Firm* — Matthew L. Grell; Jeffrey C. Watson; Grell & Watson Patent Attorneys LLC

(57) ABSTRACT

An ambidextrous glove for facilitating accurate tactility and dexterity on the distal finger pad tips. The glove has finger tip inserts facilitating tactile sensitivity. The inserts are located between the finger tips and first joint on both sides of at least the thumb, index finger, and middle finger. Optionally, the glove is turned inside out. Holes are cut in both sides of the finger tip. The inserts are adhered to the finger tip to cover the holes. If the glove was turned inside out, it is turned outside out.

4 Claims, 6 Drawing Sheets

(56) References Cited

U.S. PATENT DOCUMENTS

| | | | | |
|---|---|---|---|---|
| 6,029,276 | A * | 2/2000 | White | A41D 19/01529 2/161.1 |
| 7,159,246 | B2 | 1/2007 | Tippey | |
| 7,805,773 | B2 | 10/2010 | Di Lorenzo et al. | |
| 7,874,021 | B2 | 1/2011 | Sunder et al. | |
| 2005/0231471 | A1 | 10/2005 | Mallard et al. | |
| 2008/0010718 | A1 | 1/2008 | Richards | |
| 2008/0282446 | A1 | 11/2008 | Komlos | |

* cited by examiner

AMBIDEXTROUS GLOVE WITH SENSITIVITY-ENHANCING DIGIT TIP INSERTS

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

This invention relates to medical gloves, which nurses, allied health professionals, and the like use during the performance of their duties, such as feeling for a patient's arteries and veins, as well as entering data into touch screen devices.

2. Description of the Related Art

Nurses and other health professionals rely heavily on their distal superior phalangeal pads (palmer side fingertips) when performing medical procedures such as drawing blood, using intravenous therapy, determining pulse, and entering data for diagnostic tests via touch screen medical devices, all while being exposed to dangerous diseases. They need a high level of tactile sensitivity and dexterity on their palmer side fingertips to perform these procedures.

Consequently, a medical glove is necessary to nurses and other health professionals. Unfortunately, the material of the palmer side fingertips of a conventional medical glove has a uniform thickness, thereby failing to provide the necessary level of tactile sensitivity and dexterity. As a result, nurses and other health professionals have difficulty in performing necessary duties.

Hence, a medical glove capable of providing a high level of tactile sensitivity and dexterity on their distal palmer finger pad tips to a degree sufficient to allow nurses and other health professionals to carry out medical procedures without uncertainty is desirable.

BRIEF SUMMARY OF THE INVENTION

The present invention satisfies a necessity and remedies the shortcomings of the prior art through the provision of a glove for facilitating accurate tactility and dexterity on the finger pad tips.

The glove has an inner surface and an outer surface with five digits and is designed to be ambidextrous, that is, the glove can be put on either hand. Each thumb/finger tip has a pair of thin distal finger tip inserts, one on each side of the finger between the finger tip end and the first joint. The inserts are composed of a material that facilitates tactile sensitivity where it is most needed by the clinician. The insert is attached to the inside surface, outside surface, or within a slit in the area surrounding the hole at the finger tip.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present application hereby incorporates by reference in its entirety U.S. patent application Ser. No. 15/098,715, on which this application is based.

The present invention is an ambidextrous glove 10 with thumb and/or finger tip inserts 20 on the both sides of the thumb and/or fingers (collectively referred to herein as "digit" or "digits"), so that the wearer has increased sensitivity regardless of which hand the glove is put on. The inserts 20 are composed of a thin, sensitive material such as latex, rubber, synthetic rubber, special rubber, lambskin, nitrile, poly-isoprene, polyurethane and the like which has the ability to be in close contact with the digit tip pads, thereby facilitating increased sensitivity and dexterity.

Figure 1:
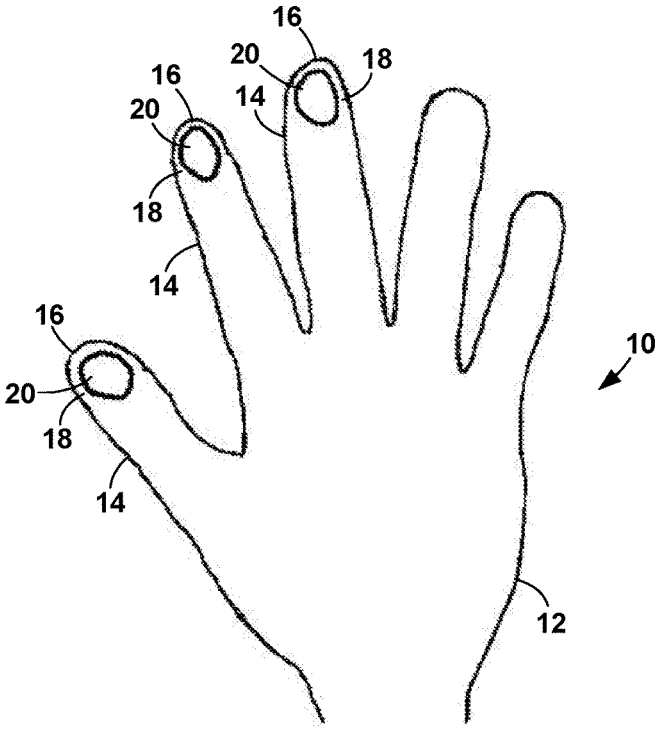
FIG. 1 is a view of the glove of the present invention with inserts on three digits.
Figure 2:
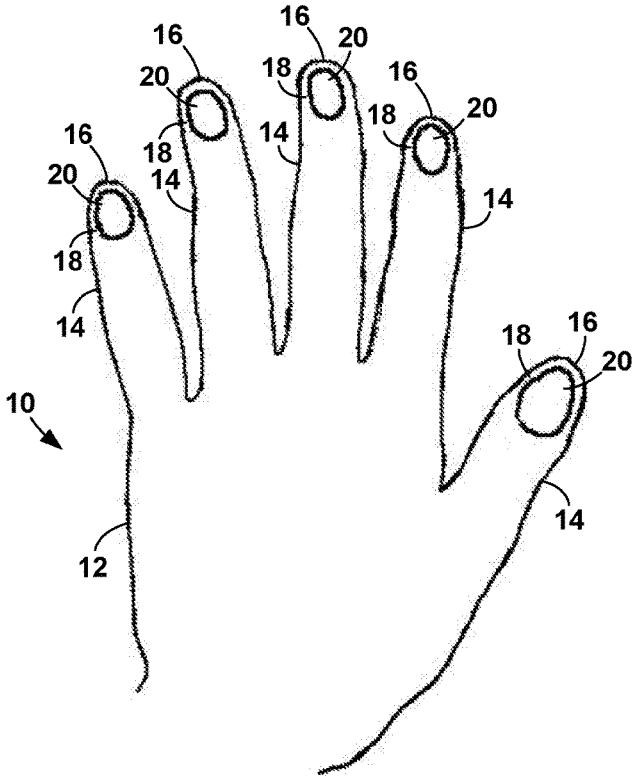
FIG. 2 is a view of the glove of the present invention with inserts on all five digits.
Figure 3:
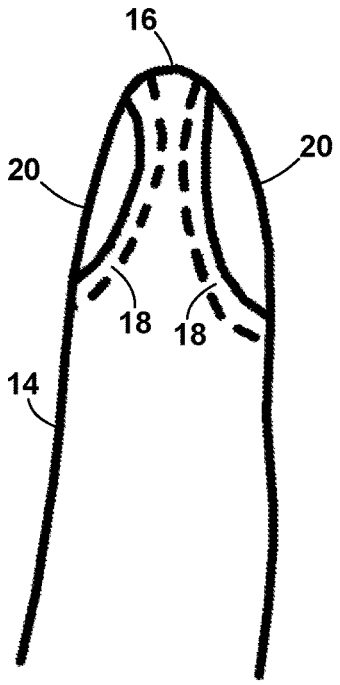
FIG. 3 is a side view of a digit showing inserts on both sides of the digit.
Figure 4:
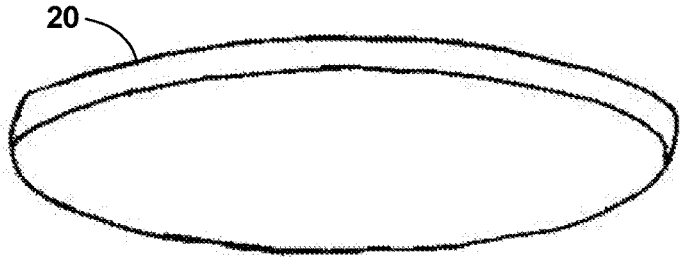
FIG. 4 is a detailed view of an insert.

The glove 10 of the present invention is depicted and exhibited in FIGS. 1-3. FIGS. 4-21 refer to components of the glove 10. Furthermore, the figures are not intended to limit the scope of the invention, but rather illustrate a representation of the presently preferred embodiments of the invention.

In reference to FIGS. 1 and 2, the figures are shown in accordance with the principles of the invention. The ambidextrous glove 10 has two components, a main unit 12, which includes the digits 14, and the inserts 20, which are attached to or otherwise integrated onto the surrounding digit surface (SDS) 18 around holes 22 on both sides of the digit tip 16. The digit tip 16 is defined as the end portion of the digit 14 from approximately the last finger joint to the end of the digit 14.

The main glove unit 12 is typically comprised of a single layer of elastic material such, as but not limited to, latex, vinyl, nitrile, isoprene, and neoprene.

The thickness of the material of the main glove 12 is measured in millimeters (mm) or mils (1 mil=0.001 inch). The thickness may vary depending on the material used, but is not typically more than 0.50 mm. Example thicknesses for various materials are shown in TABLE A.

TABLE A

| Material | Average finger tip thickness | Average cuff thickness |
|---|---|---|
| Neoprene | 0.18 mm = 7.1 mils | 0.14 mm = 5.5 mils |
| Poly-isoprene | 0.18 mm = 7.1 mils | 0.14 mm = 5.5 mils |
| Poly-isoprene | 0.18 mm = 7.1 mils | 0.14 mm = 5.5 mils |
| Poly-isoprene | 0.18 mm = 7.1 mils | 0.14 mm = 5.5 mils |
| Latex | 0.13 mm = 5.1 mils | 0.08 mm = 3.1 mils |
| Latex | 0.13 mm = 5.1 mils | 0.08 mm = 3.1 mils |
| Latex | 0.13 mm = 5.1 mils | 0.08 mm = 3.1 mils |
| Latex | 0.14 mm = 5.5 mils | 0.09 mm = 3.5 mils |
| Latex | 0.14 mm = 5.5 mils | 0.09 mm = 3.5 mils |
| Latex | 0.16 mm = 6.2 mils | 0.10 mm = 4.0 mils |
| Latex | 0.16 mm = 6.2 mils | 0.10 mm = 4.0 mils |
| Latex | 0.23 mm = 9.5 mils | 0.20 mm = 7.8 mils |
| Latex | 0.23 mm = 9.5 mils | 0.20 mm = 6.5 mils |
| Latex | 0.31 mm = 12.5 mils | 0.24 mm = 9.4 mils |
| Latex | 0.23 mm = 9.1 mils | 0.17 mm = 6.5 mils |
| Bismuth Oxide Latex | 0.35 mm = 13.7 mils | 0.24 mm = 9.3 mils |
| Nitrile | 0.30 mm = 11.8 mils | 0.30 mm = 11.8 mils |

For a given material, one may assume that thinner gloves allow better dexterity and flexibility, whereas thicker gloves provide better protection but less flexibility. With the highly-sensitive material attached to or integrated with the main glove unit 12 onto the surrounding digit surface 18, a degree of integrity is maintained and the level of sensitivity and dexterity is enhanced.

The highly-sensitive material that is connected or integrated at the surrounding digit surface 18, which makes up distal digit tips 16 of the glove digits 14, is comprised of a single thin layer of material, which is composed of but is not limited to latex, polyurethane, poly-isoprene, and/or polyurethane film (TEGADERM).

Examples of thicknesses of various compositions of highly-sensitive material are shown in TABLE B, with a contemplated maximum thickness of 0.20 mm.

TABLE B

| Material | Thickness in mm |
|---|---|
| Latex | 0.044 to 0.121 |
| Polyisoprene | 0.045 to 0.06 |

TABLE B-continued

| Material | Thickness in mm |
|---|---|
| Polyurethane | 0.0011 to 0.0027 |
| Polyurethane film (TEGADERM) | 0.025 |

Polyurethane can be made thinner than latex and it also has the ability to transmit body heat better than latex. The advantages of polyurethane include its ability to transfer body heat, odorless, clear, no latex allergens, strength, and compatibility with water-based and oil-based lubricants. The disadvantages are that it is not as elastic as latex and the selection is very limited.

Polyisoprene has all the characteristics of latex plus it is soft, is a non-latex material, has good elasticity, strength, and is compatible with water-based lubricants. The disadvantage is that it is not compatible with oil-based lubricants.

The advantages of polyurethane film are that it retains moisture, is impermeable to bacteria, facilitates autolytic debridement, allows wound observation, and does not require a secondary dressing. The disadvantages are as follows: may not be required for infected wounds, not required for wounds with heavy drainage, requires a border of intact skin adhesive edge dressing, may be difficult to apply and handle, may dislodge in high friction areas.

In reference to the drawings, characteristics have been explicitly described which correspond to designated parts throughout the several depictions. The main glove unit 12 can be composed of any one or more of the materials in TABLE A. For example, the main glove unit 12 in FIGS. 1, 2, and 5 can be composed of 8-mm-thick nitrile.

In addition, the inserts 20 can be composed of any one or more of the materials in TABLE B. For example, the inserts 20 can be composed of 0.0027-mm-thick polyurethane. Alternatively, the insert 20 can be composed of 0.0027-mm-thick polyurethane.

Figure 5:
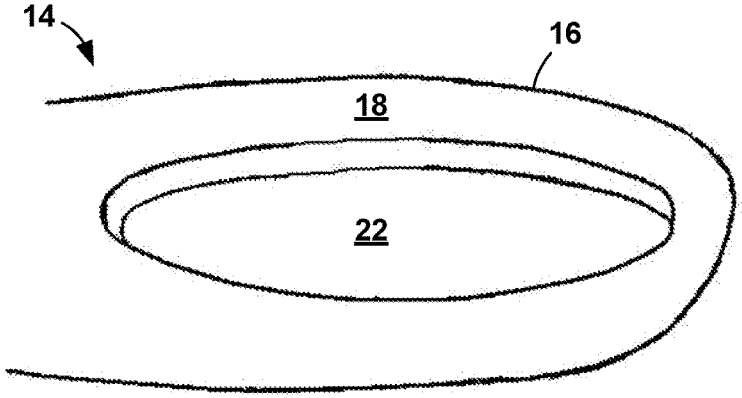
FIG. 5 is a detailed view of one side of the digit tip with a hole and surrounding surface.

The insert 20 can be attached to or integrated with the main unit glove's distal surrounding digit surface (SDS) 18 in order to cover the holes 22 of both sides of the five digit tips 16. The acronym, SDS, refers to the surface 18 surrounding the hole 22, as shown in FIG. 5.

Attachment to or integration between the inserts 20 and the SDS 18 on the tips 16 can be achieved by any one or more of various methods. Such methods include, but are not limited to, adhesive, compression, heating, melting, and other manipulations through physical or chemical means. Therefore, the present invention contemplates the use of any method that will attached the insert 20 to the digit tip 16.

The various materials used for the main glove unit 10 may have a greater thickness than the various thin materials used for the inserts 20. As a result, the combined thickness of the two components may be different than the two parts separated, but not necessarily, since some methods of combination may result in the two components' thicknesses being uniform.

When the inserts 20 are attached to the tips 16, both the main glove unit 10 and inserts 20 act as a barrier for protection of the user.

The present invention contemplates a number of different methods for attaching the insert 20 onto the SDS 18 of the tip 16. These different methods are shown in FIGS. 6-21.

Figure 6:
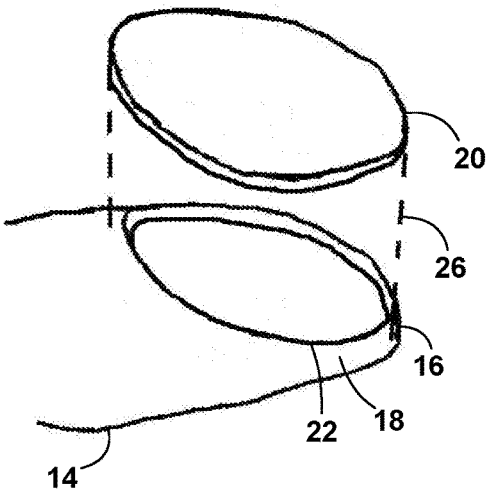
FIG. 6 is a detailed, exploded view of the insert attached to the outside of the digit tip.
Figure 7:
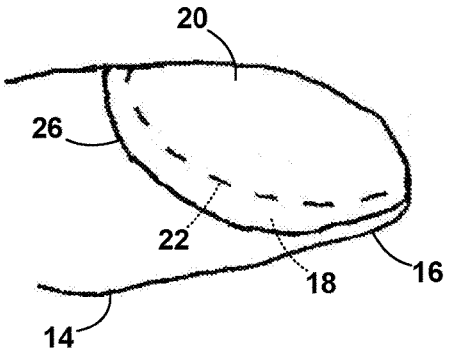
FIG. 7 is a detailed, assembled view of the insert attached to the outside of the digit tip.

In the attachment of FIGS. 6 and 7, a hole 22 is made in the digit tip 16 that is smaller than the size of the insert 20. The digit 14 is left in the outside out position and the insert 20 is attached, as at 26, onto the SDS 18 around the hole 22 by whatever means is appropriate, for example, by adhesive or heat. For the typical thumb, the length Y (along the length of the digit) of the insert 20 is approximately 2.5 cm and the width X (laterally across the digit) of the insert 20 is approximately 2.0 cm. For the typical finger, the length Y of the insert 20 is approximately 2.5 cm and the width X of the insert 20 is approximately 2.0 cm.

Figure 8:
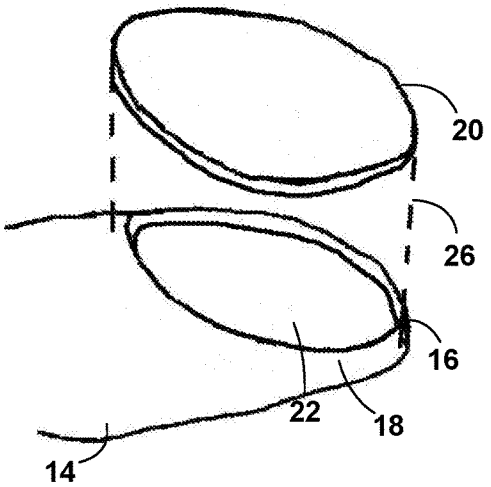
FIG. 8 is a detailed, exploded view of the insert attached to the inside of the digit tip.
Figure 9:
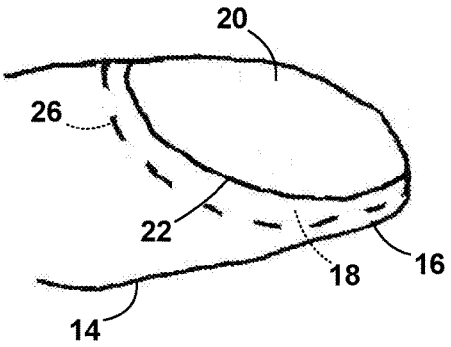
FIG. 9 is a detailed, assembled view of the insert attached to the inside of the digit tip.
Figure 10:
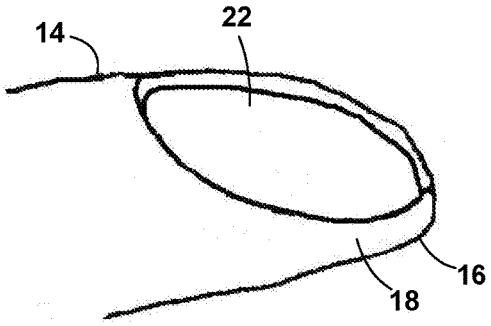
FIG. 10 is a detailed view of the first step, hole cut, of the lateral incision method of attaching the insert.
Figure 11:
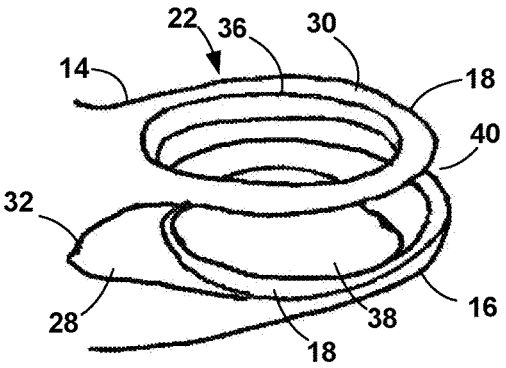
FIG. 11 is a detailed view of the second step, lateral incision, of the lateral incision method of attaching the insert.
Figure 12:
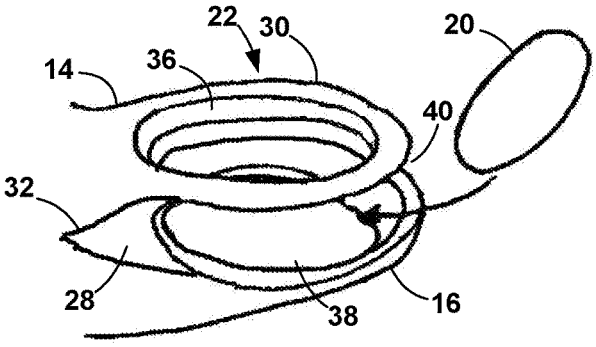
FIG. 12 is a detailed view of the third step, insert placement, of the lateral incision method of attaching the insert.
Figure 13:
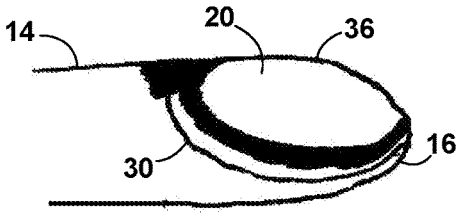
FIG. 13 is a detailed view of the fourth step, insert attachment, of the lateral incision method of attaching the insert.
Figure 14:
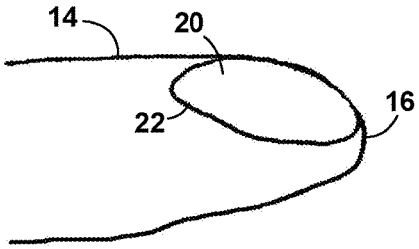
FIG. 14 is a detailed, assembled view of the insert attached via the lateral incision method.
Figure 15:
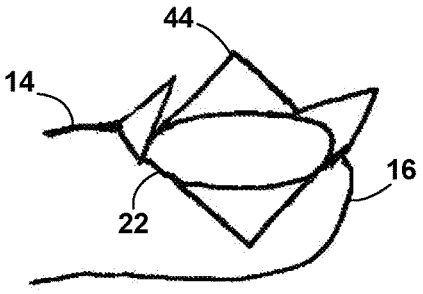
FIG. 15 is a detailed view of the first step, hole cut, of the triangular flap method of attaching the insert.

In the attachment of FIGS. 8 and 9, a hole 22 is cut in the digit tip 16 that is smaller than the size of the insert 20. The glove 10 is turned inside out and the insert 20 is attached onto the SDS 18 around the hole 22 by whatever means is appropriate, for example, by adhesive or heat. After the insert 20 is attached, the glove 10 is turned outside out.

In the attachment of FIGS. 10-14, a hole 22 is cut in the digit tip 16 that is smaller than the size of the insert 20. The glove 10 can be in either outside out or inside out. In either case, a thin lateral incision 28 is made below the hole 22, either approximately ⅛", 1/16", or 1/32" below the hole 22, whichever is appropriate. The lateral incision 28 extends away from the digit tip 16 creating a flap 30 with a connected rear attachment 32 of ¼" to ⅛". The flap has an upper hole 36 and the digit 14 has a lower hole 38. There is a gap 40 between the digit 14 and the flap 30. The SDS 18 is in two parts, one surrounding the upper hole 36 and one surrounding the lower hole 38.

The insert 20 is inserted into the rear most part of the gap 40, where the upper peripheral surface of the insert is attached to the under surrounding surface of the upper hole 36 in the flap 30 and the lower peripheral surface of the insert is attached to the upper surrounding surface of lower hole 38 by whatever means is appropriate, for example, by adhesive or heat. Either after attaching the insert 20 or at the same time, the flap 30 is reattached to the digit 14 (the incision 28 is closed) by whatever means is appropriate, for example, by adhesive or heat.

Figure 21:
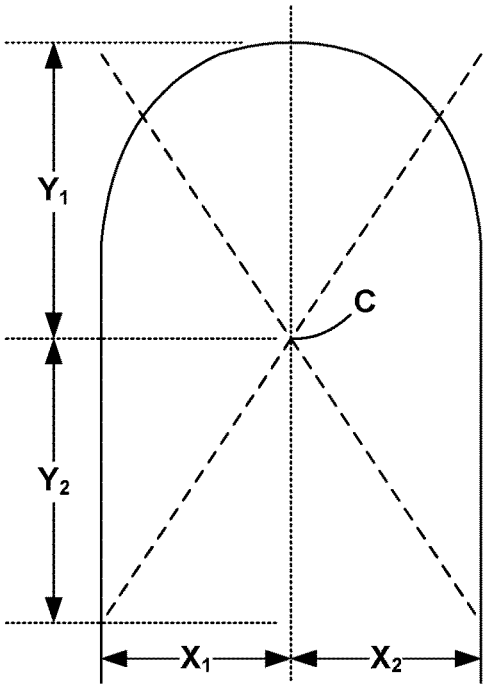
FIG. 21 is a detailed view of the cut parameters for the triangular flap method.

In the attachment method of FIGS. 15-19 the glove 10 is turned inside out. With reference to precut FIG. 21, the corresponding cuts for the hole 20 are made so that triangular flaps 44 are produced. FIG. 21 shows example cut parameters. TABLE C lists the parameters for fingers and thumb for the typical glove 10.

TABLE C

| Parameter | Thumb | Index Finger | Middle Finger |
|---|---|---|---|
| C to side $X_1$ | 0.75 cm | 0.75 cm | 0.75 cm |
| C to side $X_2$ | 0.75 cm | 0.75 cm | 0.75 cm |
| C to Tip $Y_1$ | 1.0 cm | 1.0 cm | 1.0 cm |
| Center to Joint $Y_2$ | 1.0 cm | 1.0 cm | 1.0 cm |

Figure 16:
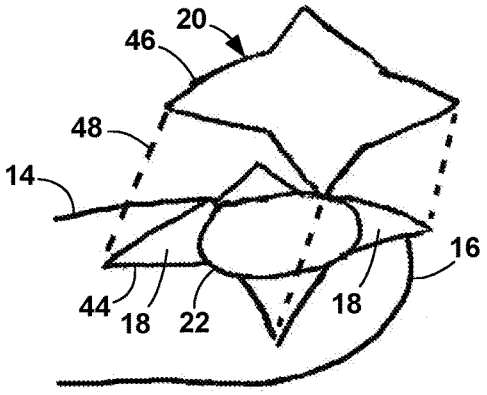
FIG. 16 is a detailed view of the second step, insert cut and attach, of the triangular flap method of attaching the insert.
Figure 17:
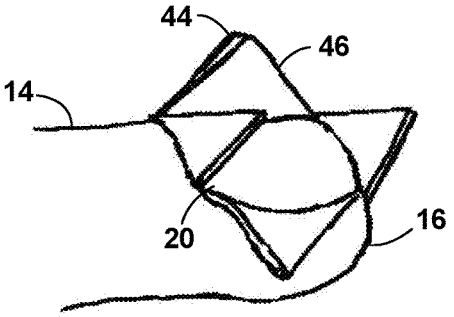
FIG. 17 is a detailed view of the third step, flap flatten, of the triangular flap method of attaching the insert.
Figure 18:
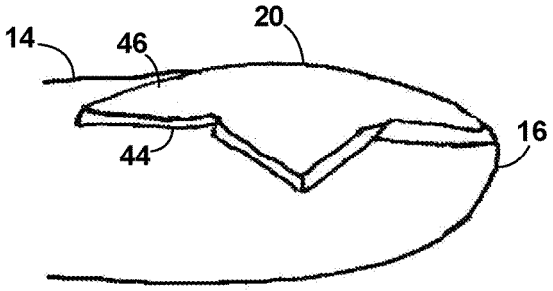
FIG. 18 is a detailed view of the fourth step, flap attach, of the triangular flap method of attaching the insert.
Figure 19:
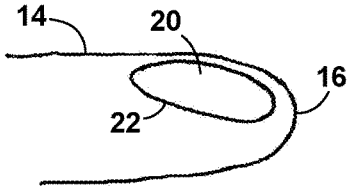
FIG. 19 is a detailed, assembled view of the insert attached the triangular flap method.

After the cuts, the flaps 44 are folded over to overlap the digit 14, as in FIG. 16. The SDS 18 is the area surrounding the hole 22 and includes the flaps 44.

The insert 20 is formed with wings 46 in the same size and shape as the flaps 44, as in FIG. 16, and the insert wings 46 are attached to the flaps 44, as at 48, by whatever means is appropriate, for example, by adhesive or heat. The overlapped wings 46 and flaps 44 are attached to the digit 14 so they are flat, as in FIG. 18, by whatever means is appropriate, for example, by adhesive or heat. After all of the inserts 20 are attached, the glove 10 is turned outside out, as in FIG. 19. Note that, if appropriate, the flaps 44 can be attached to the digit 14 before the wings 46 are attached to the flaps 44.

Figure 20:
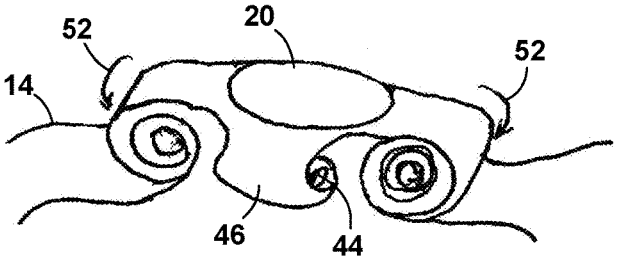
FIG. 20 is a detailed alternative rolled attachment for the triangular flap method.

FIG. 20 shows an alternate attachment of the insert 20 to the digit 14. Adhesive is placed on the surface of flaps 44 and attached to wings 46. The flaps 44 and wings 46 are then rolled, as at 52, and both are bonded such that the adhesive is placed at the base of rolled flap/wing combination so it is secured. After all of the inserts 20 are attached, the glove 10 is turned outside out, as in FIG. 19.

Thus it has been shown and described an ambidextrous glove with sensitivity-enhanced digit tip inserts on both sides of the digit. Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An ambidextrous glove comprising:

(a) a main portion and five digits with distal digit tips, all composed of an elastic material not more than 0.50 mm thick;

(b) at least three of the distal digit tips having inserts on both sides of the distal digit tips where opposed spaced apart inserts are positioned on each of the three distal digit tips, the inserts being composed of a thin sensitive material; and (c) each side of the at least three of the distal digit tips having a hole with a surrounding digit surface, the insert placed to cover the hole and attached to the surrounding digit surface.

2. The ambidextrous glove of claim 1 wherein the elastic material is selected from the group consisting of latex, vinyl, nitrile, isoprene, and neoprene.

3. The ambidextrous glove of claim 1 wherein the sensitive material is no more than 0.20 mm thick and is selected from the group consisting of latex, rubber, synthetic rubber, lambskin, nitrile, poly-isoprene, and polyurethane.

4. The ambidextrous glove of claim 1 wherein five of the distal digit tips have the inserts.

* * * * *